US007121329B2

(12) United States Patent
Shields et al.

(10) Patent No.: US 7,121,329 B2
(45) Date of Patent: Oct. 17, 2006

(54) PLASTIC TANKED HEAT EXCHANGER-SIDE, HEADER TANK ASSEMBLY

(75) Inventors: Thomas M. Shields, Racine, WI (US); Rachel Olsonawski, Racine, WI (US); Robert J. DeGroot, Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 323 days.

(21) Appl. No.: 10/012,610

(22) Filed: Oct. 30, 2001

(65) Prior Publication Data

US 2003/0205367 A1 Nov. 6, 2003

(51) Int. Cl.
*F28D 1/00* (2006.01)

(52) U.S. Cl. ..... 165/149; 165/178

(58) Field of Classification Search ..... 165/173, 165/175, 149, 178
See application file for complete search history.

(56) References Cited

U.S. PATENT DOCUMENTS 4,645,002 A * 2/1987 Keyzer ..... 165/173
4,651,815 A 3/1987 Logic et al.
5,186,246 A 2/1993 Halstead
5,195,579 A 3/1993 Buchanan
5,195,582 A 3/1993 Haase
5,219,017 A 6/1993 Halstead et al.
5,366,008 A * 11/1994 Kadle et al. ..... 165/173
5,390,733 A 2/1995 Young
5,758,721 A * 6/1998 Letrange et al. ..... 165/173
6,082,446 A 7/2000 Ahaus et al.

FOREIGN PATENT DOCUMENTS

DE 2703528 * 8/1978 ..... 165/173
DE 32 22 300 A1 12/1983
DE 297 04 913 U1 7/1998
DE 197 25 427 A1 12/1998
FR 2 735 855 A1 12/1996
FR 2 790 075 A1 8/2000
GB 1285740 8/1972

* cited by examiner

*Primary Examiner*—Ljiljana Ciric
(74) *Attorney, Agent, or Firm*—Wood, Phillips, Katz, Clark & Mortimer

(57) ABSTRACT

A tank to header attachment construction for heat exchangers include T-shaped tabs on the header which extend through slots in a flange on a tank. The top bar of each tab has it ends bent out of alignment with the slot to secure the tank to the header.

5 Claims, 4 Drawing Sheets

PLASTIC TANKED HEAT EXCHANGER-SIDE, HEADER TANK ASSEMBLY

FIELD OF THE INVENTION

This invention relates to heat exchangers of the type having a header receiving the open ends of a plurality of tubes and a tank and/or side piece secured to the header; and more particularly, to an improved attachment of the tank and/or side piece to the header for brazing.

BACKGROUND OF THE INVENTION

Heat exchangers commonly have a plurality of parallel flat sided extruded or roll formed tubes connected at opposite ends to a pair of header-tank assemblies, and a plurality of fins between and bonded to the tubes to facilitate efficient heat transfer to the surrounding area. Each header-tank assembly generally comprises a header with slots therethrough for receiving the tubes, and a tank secured to the header to contain a heat exchange fluid medium and receive the same from the tubes. The fins are brazed or soldered to the sides of adjacent tubes, and the tubes are brazed or otherwise bonded to the header along with the tank to assure leak free joints.

During assembly, the header and tank must be secured to one another to seal the joint therebetween. Tabs of various sorts are known for tank retention of headers. For example, T-shaped tabs located on the header are employed in Buchanan U.S. Pat. No. 5,195,579. In this patent, the so-called bars or tops of the T-shaped tabs are bent inwardly in their entirety over a flange on the tank so as to hold the header and tank assembly together. While such known connections between the tank and the header may perform acceptably for their intended purpose, there is always room for improvement. For example, there is a continuing desire to make the connection easier to form and to improve pressure resistance. In addition, there is a need for an improved means of attaching side pieces to the headers.

SUMMARY OF THE INVENTION

It is the principal object of the invention to provide a new and improved means of assembling a header and tank and/or a side piece with a header in a heat exchanger, and more specifically, to provide an improved means to lock the side piece and/or the header to assure braze joint and maintain header to header dimension during brazing.

According to one aspect of the invention, a heat exchanger comprises a tank, a header and a plurality of tubes. The tank has a flange that extends around a periphery of an open end of the tank. The flange has a plurality of spaced openings. The header receives open ends of the tubes. A plurality of tabs extend from an outer periphery of the header. The tabs pass through the openings and are bent to a position overlying the flange to prevent removal of the tank from the header. The tabs are T-shaped. Each of the T-shaped tabs has an upright part extending from the outer periphery of the header and a top bar connected with the upright part. With the T-shaped tabs passing through the openings in the tank, the top bars are bent to a position overlying the flang of the tank to prevent removal of the tank from the header.

In a preferred embodiment, only the ends of the top bars are bent to overly the flange.

According to another aspect of the invention, the heat exchanger further comprises a side piece. The side piece includes a tab extending from its ends. Each tab has an aperture. The header has a slot at a side of the header and includes a deformable tab extending from the header. With the tab of the side piece located in the slot, the deformable tab is deformed into the aperture to lock the side piece to the header. In one form, the tab of the side piece is T-shaped. The T-shaped tab passes through the corresponding opening in the tank and is bent to overlie the flange to secure the tank to the side piece.

Other objects and advantages will become apparent from the following specification taken in connection with the accompanying drawings.

DESCRIPTION OF THE PREFERRED EMBODIMENT

Figure 1:
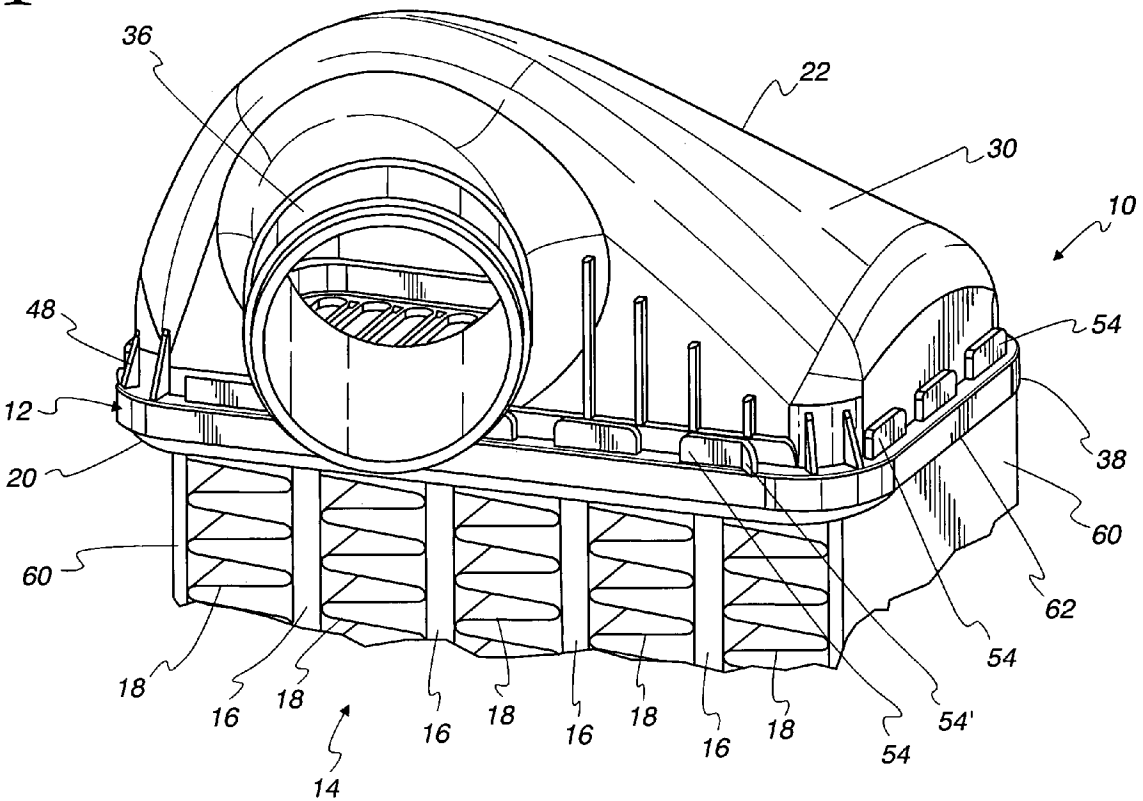
FIG. 1 is a fragmentary perspective view of a heat exchanger including a header-tank assembly and a pair of side pieces in accordance with one embodiment of the invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention as illustrated therein being contemplated as would normally occur to one skilled in the art to which the invention relates.

FIG. 1 is a fragmentary perspective view of a heat exchanger 10. The heat exchanger 10 comprises a pair of header-tank assemblies 12, only one of which is shown. The header-tank assemblies 12 support a core 14 therebetween. The core 14 includes a plurality of flat sided tubes 16 formed by extrusion, roll forming or the like and of a heat exchange fluid medium arranged in parallel relationship for providing parallel flow. A plurality of fins 18 are arranged between the tubes 16 for thermal coupling of the tubes 16 with ambient air.

Figure 3:
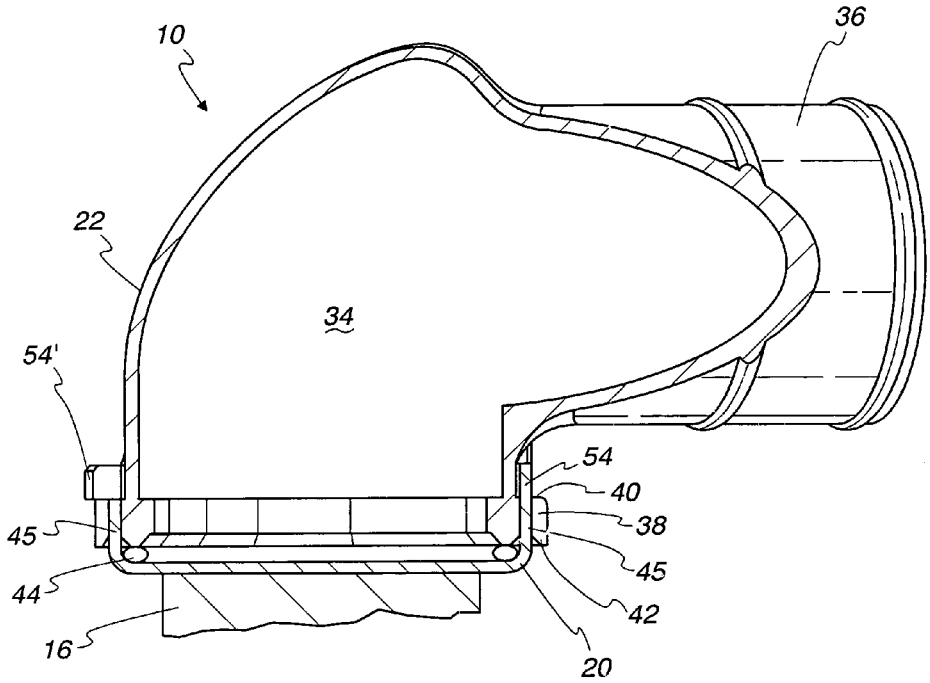
FIG. 3 is a fragmentary partial sectional view of the heat exchanger of FIG. 1.
Figure 5:
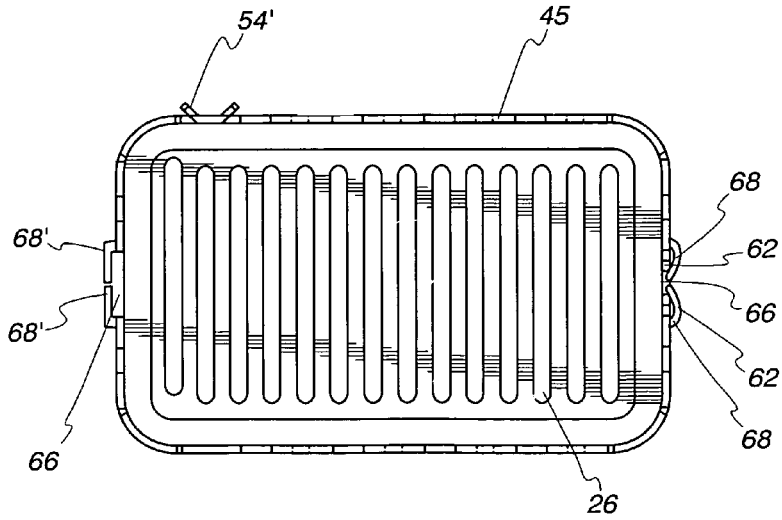
FIG. 5 is a plan view of the header of FIG. 1.
Figure 4:
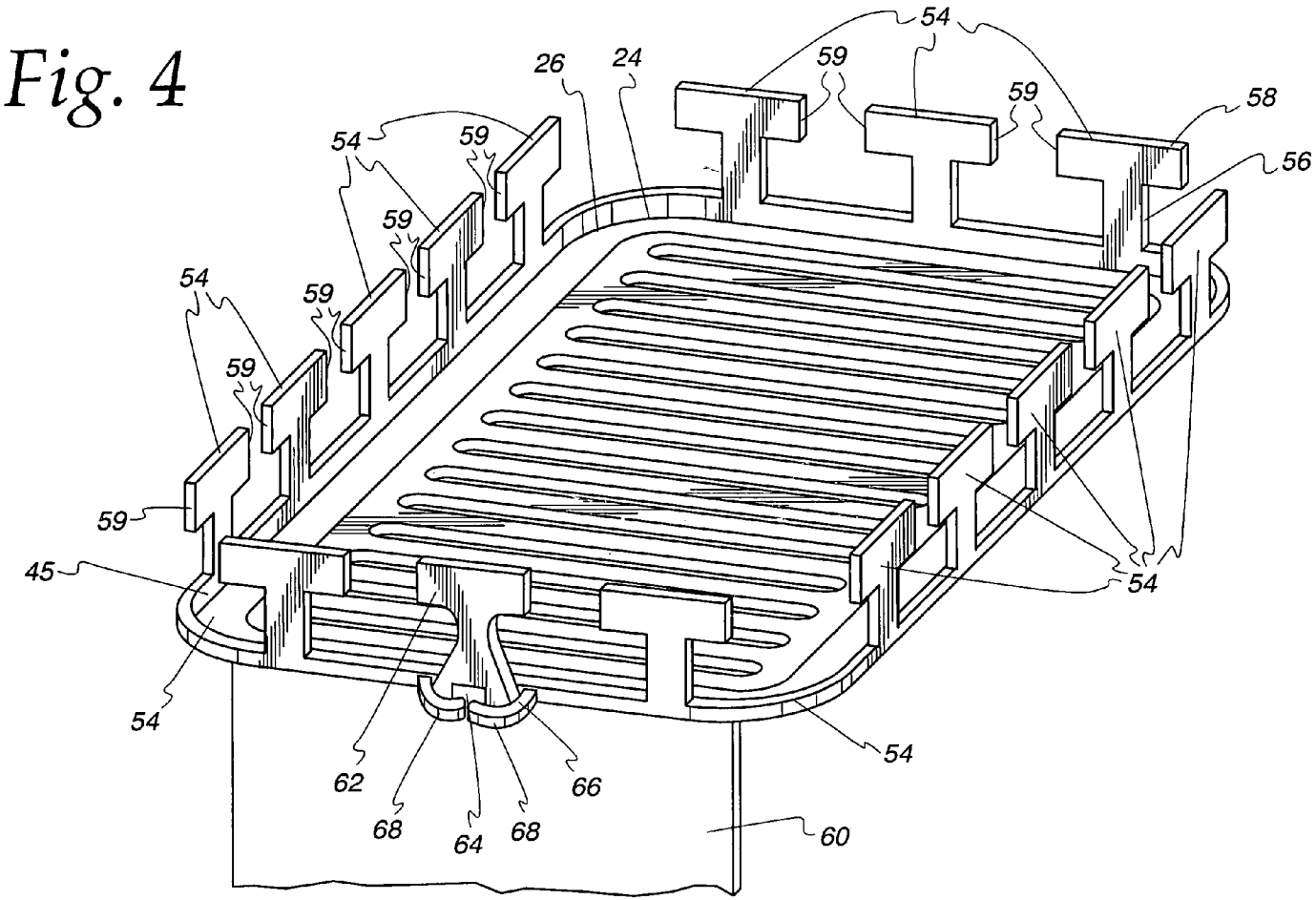
FIG. 4 is a perspective view of the side piece attached to the header of FIG. 1.

The header-tank assembly 12 is formed by a header 20 and a tank 22. The header 20 includes a plate 24 having a plurality of slots 26, as best seen in FIGS. 4 and 5, for receiving the open ends of the tubes 16 which are in turn bonded thereto. The tank 22 includes a cover side 30 and an opposite open end 32. Assembly of the tank 22 onto the header 20 results in formation of a flow channel 34 (see FIG. 3). A heat exchange fluid medium to be heated or cooled flows into or out of the flow channel 34 through the tubes 16. The tank 22 may also include one or more circular ports 36 in fluid communication with the flow channel 34 for flowing the medium into or out of the flow channel 34.

Figure 2:
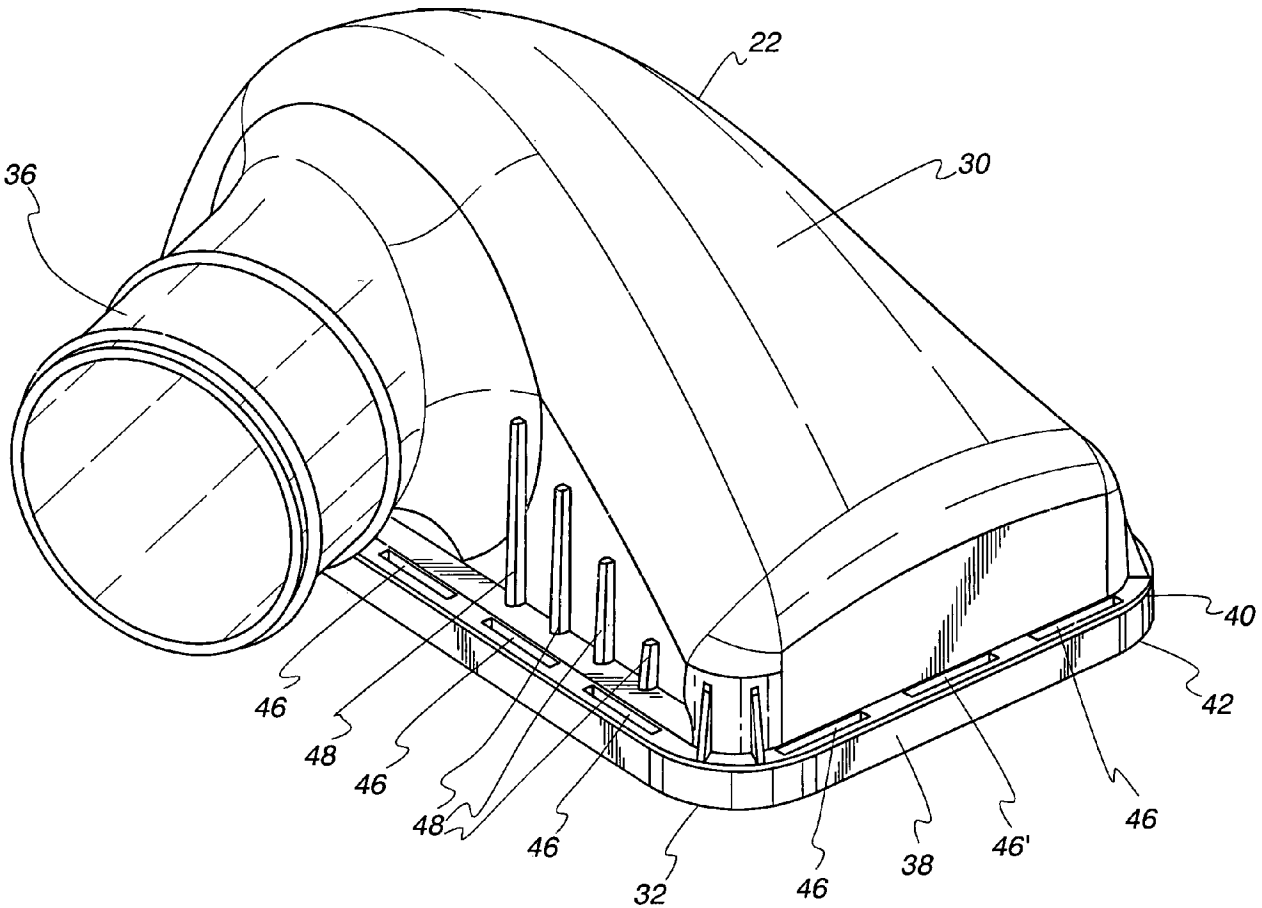
FIG. 2 is a perspective view of a tank of the header-tank assembly of FIG. 1.

Referring to FIG. 2, the tank 22 also includes a flange 38 that extends around the periphery of the open end of the tank 22 and extends outwardly therefrom and extends outwardly therefrom. The flange 38 has a plurality of spaced openings 46 about the periphery of the tank 22 and two centered openings 46' (only one shown in FIG. 2) at two sides of the tank 22 respectively. Preferably, the openings 46 and 46' are rectangular. The flange 38 includes an upper surface 40 and a bottom surface 42 that is useful for sealing against a peripheral seal 44 as shown in FIG. 3. The seal is placed within the header 20 prior to the coupling of the tank 22 to the header 20. The seal 44 is preferably an o-ring. The seal 44 is located just within an upstanding flange 45 that extends peripheral about the header plate 24. The seal 44 may be of any form known to those of ordinary skill in the art. Referring to FIG. 2, the tank 22 also includes a plurality of ribs 48 spaced relatively flat parts of the exterior surface of the cover 30 and extend to the upper surface 40 of the flange 38. The ribs 48 stiffen the cover 30 so as to resist the pressure within the flow channel 34 allowing a relatively thin cover. However, those of ordinary skill in the art will recognize that by thickening the cover 30 or substituting a high strength material for the manufacture of the tank 22, it is not necessary to have the ribs. The tank 22 is typically made from a heat resistant structural plastic.

With respect to FIG. 4, the header plate 24 is surrounded by a peripheral flange 45 as mentioned previously. A plurality of tabs 54 project upward from the flange 45 and extend generally around the periphery of the header 20. The tabs 54 are T-shaped. Each of the T-shaped tabs 54 has an upright part 56 extending from the peripheral edge wall 50 of the header 20 and a top bar 58 connected with the upright part 56 at its midpoint. The T-shaped tabs 54 pass through the openings 46 and 46' in the tank 22 and the ends 59 of the top bars 58 are deformed to either side of the upright part 56 of generally toward or away from the tank 22 to overlie the upper surface 40 of the tank flange 38 to assemble of the tank 22 to the header 20. The deformed tabs are indicated with 54' as shown in FIGS. 1 and 3.

In the usual case, the tank 22 is fitted to the header with the seal 44 in place. The tank and header are moved together to compress the seal 44 and to cause the top bars 58 to clear the upper surface 40 of the flange 38 and compress the seal 44. The top bars 58 are then deformed, leaving the seal 44 in compression, or at least an contact with both the header plate 24 and tank flange 38. The header 20 is preferably fabricated from a brazeable material, such as by way of example only, aluminum.

In one embodiment, the heat exchanger 10 also includes a pair of side pieces 60 secured to the header 20 and the tank 22 as shown in FIG. 1 to protect the fins 18 on the end most tubes 18 and/or assist in holding various components together during assembly. With respect to FIG. 3, a tab 62 extends from each end (only one shown) of the side piece 60. There is an aperture 64 at the bottom of the tab 62. Preferably, the tab 62 is T-shaped. The side pieces 60 are typically made from aluminum. As best seen in FIG. 5, the peripheral flange 45 of the header 20 further includes a pair of slots 66 at two sides of the header 20 respectively. Referring to FIG. 4, a pair of deformable tabs 68 extend from the peripheral flange 50 of the header 20 proximate to the slots 66. With the side piece tab 62 located in the corresponding slot 66, the deformable tab 68 of the header 20 is deformed into the aperture 64 of the side piece tab 62 to lock the side piece 60 to the header 20. The tab of the header at 68' in its deformed state is indicated with 68' as shown in FIGS. 4 and 5. With the T-shaped tab 62 of the side piece passing through the corresponding opening 46' in the tank 22 as shown in FIG. 1, the top bar of T-shaped tab 62 of the side piece 60 is bent to overlie the upper surface 40 of the tank flange 38 (not shown) as stated above.

From the foregoing, it will be appreciated that the header 20 may be attached to the tank 22, for example, by means of the T-shaped taps 54 of the header 20 passing through the openings 46 and 46' in the tank flange 38 and bent to overlie the tank flange 38.

It should be appreciated that the side piece 60 can be attached to the header 20, for example, by means of the deformable tab 68 of the header 20 inserted into the aperture 64 of the side piece tab 62.

It should also be appreciated that the side piece 60 can be attached to the tank 22, for example, by means of the T-shaped side piece tab 62 passing through the corresponding opening 46' in the tank 22 and bent to overlie the tank flange 38.

What is claimed is:

1. A heat exchanger having a plurality of tubes, each of the tubes having an open end, the heat exchanger comprising:

a tank having a flange that extends around an periphery of an open end of the tank, the flange having a plurality of spaced openings; and a header supporting the open ends of the tubes and including a plurality of tabs extending from an outer periphery of the header, the tabs passing through the openings and bent to a position overlying the flange to prevent removal of the tank from the header;

wherein the tabs are T-shaped, each of the T-shaped tabs has an upright part extending from the outer periphery of the header and a top bar connected with the upright part, the openings in the tank sized to allow passage of the top bars therethrough, with the T-shaped tabs passing through the openings in the tank, the top bars are bent to a position overlying the flange of the tank to prevent removal of the tank from the header.

2. A heat exchanger having a plurality of tubes, each of the tubes having an open end, the heat exchanger comprising:

a tank having a flange that extends around an periphery of an open end of the tank, the flange having a plurality of spaced openings;

a header supporting the open ends of the tubes and including a plurality of first tabs extending from an outer periphery of the header, the first tabs passing through the openings and bent to a position overlying the flange to prevent removal of the tank from the header; and a side piece, the side piece including a second tab extending from the side piece and having an aperture;

wherein the header has a slot at a side of the header and includes a deformable third tab extending from the header, with the second tab of the side piece located in the slot, the deformable third tab is deformed into the aperture to lock the side piece to the header.

3. The heat exchanger of claim 2 wherein the second tab of the side piece is T-shaped, the T-shaped second tab has an upright part extending from the side piece and a top bar connected with the upright part, with the T-shaped second tab passing through the corresponding opening in the tank, the top bar is bent to a position overlying the flange of the tank to prevent removal of the tank from the side piece.

4. The heat exchanger of claim 3 wherein said top bar has ends which are bent to a position overlying the flange of the tank.

5. A heat exchanger having a plurality of tubes, each of the tubes having an open end, the heat exchanger comprising:

a tank having a flange extending from an outer periphery of the tank, the flange having a plurality of spaced openings;

a header receiving the open ends of the tubes, the header having a slot, the header further including a plurality of T-shaped tabs extending from an outer periphery of the header and passing through the openings in the tank, each of the T-shaped tabs has an upright part extending from the outer periphery of the header and a top bar connected with the upright part, with the T-shaped tab passing through the openings, the top bars are bent to a position overlying the flange of the tank to prevent removal of the tank from the header; and a deformable tab extending from the outer periphery of the header; a side piece including a T-shaped tab extending from the side piece, the T-shaped tab of the side piece having an aperture, the T-shaped tab of the side piece having an upright part extending from the side piece and a top bar connected with the upright part, with the T-shaped tab of the side piece located in the slot and passing through the corresponding opening in the tank, the deformable tab of the header is deformed into the aperture to lock the side piece to the header and the top bar is bent to a position overlying the flange of the tank to prevent removal of the tank.

* * * * *